United States Patent [19]

Klubitschko et al.

[11] Patent Number: 4,624,474

[45] Date of Patent: Nov. 25, 1986

[54] STEP-IN YIELDING HEEL PIECE FOR SAFETY SKI BINDING

[75] Inventors: Gerd Klubitschko, Oberau; Premak Stepanek, Garmisch-Partenkirchen, both of Fed. Rep. of Germany

[73] Assignee: Marker International Company, Salt Lake City, Utah

[21] Appl. No.: 658,916

[22] PCT Filed: Feb. 11, 1983

[86] PCT No.: PCT/EP83/00032

§ 371 Date: Oct. 5, 1984

§ 102(e) Date: Oct. 5, 1984

[87] PCT Pub. No.: WO84/03050

PCT Pub. Date: Aug. 16, 1984

[51] Int. Cl.[4] ..... A63C 9/082; A63C 9/088

[52] U.S. Cl. ..... 280/612; 280/628; 280/632; 280/634

[58] Field of Search ..... 280/611, 612, 628, 631, 280/632, 634

[56] References Cited

U.S. PATENT DOCUMENTS

| | | | |
|---|---|---|---|
| 3,871,673 | 3/1975 | Murata | 280/11.35 T |
| 3,919,563 | 11/1975 | Lautier et al. | 280/612 |
| 3,940,156 | 2/1976 | Marker | 280/11.35 R |
| 4,130,296 | 12/1978 | D'Antonio et al. | 280/612 |
| 4,457,534 | 7/1984 | Richert | 280/631 |

FOREIGN PATENT DOCUMENTS

| | | |
|---|---|---|
| 1578959 | 8/1973 | Fed. Rep. of Germany . |
| 2251833 | 5/1974 | Fed. Rep. of Germany . |
| 2109799 | 5/1972 | France . |

*Primary Examiner*—David M. Mitchell
*Assistant Examiner*—Richard M. Camby
*Attorney, Agent, or Firm*—D. Peter Hochberg

[57] ABSTRACT

A step-in heel piece for a safety ski binding which yields, in its latching position, away from the sole plate of the binding in response to the influence of external forces. The yielding heel piece improves skier comfort and accommodates various ski boot heel sole thicknesses without mechanical adjustment.

18 Claims, 15 Drawing Figures

STEP-IN YIELDING HEEL PIECE FOR SAFETY SKI BINDING

BACKGROUND OF THE INVENTION

The present invention relates to safety ski bindings. Ski bindings lock or latch to grip a ski boot, generally by gripping the edge of the sole at the heel and the toe, and hold it, and the skier whose leg is in the boot, to a ski. A binding is attached, for example, by screws, to a ski. A safety ski binding is designed to release the grip on a ski boot when the skiing forces on the boot and skier's leg exceed some predetermined threshold which threatens the safety of the skier. It is known in the art that the skiing forces may be detected mechanically or electronically. See U.S. Pat. No. 4,291,894, issued Sept. 29, 1981 to D'Antonio and Bates.

For convenience in use, it is desirable that a safety ski binding be of the "step-in" type. In that type of binding, the skier cocks the release mechanism by stepping into the binding. Other binding types require particular cocking actions by the skier in addition to stepping into the binding. Some bindings require the throwing of a lever before the binding is ready for use. The known electronic safety ski bindings, for example the type shown in U.S. Pat. No. 4,130,296 issued Dec. 19, 1978 to D'Antonio and Bates, require a skier to cock the release mechanism manually in order to prepare the binding for use.

It has been found that a latched binding which grips the sole of a boot tightly against the ski results in discomfort and fatigue for the skier during long periods of use. Many bindings are also limited in their latching position to use with a particular thickness of boot sole. A change of boot style or type usually requires a mechanical adjustment or remounting of the binding on the ski to accommodate a change in sole thickness. In the present invention, these difficulties are overcome by providing a yielding heel piece for gripping the sole of a ski boot adjacent the heel of the boot. While in its latching position, the inventive heel piece yields, i.e., moves through a limited range relative to the surface of the ski in response to forces having magnitudes below the predetermined, threatening threshold level. The yielding movement reduces the skier fatigue that is experienced with latched bindings that do not yield with respect to a ski. The yielding movement also permits a large range of sole thicknesses to be accommodated in the latched binding without mechanical adjustment of the binding.

SUMMARY OF THE INVENTION

The advantages of the invention in its preferred forms are accomplished through a ski binding heel piece which includes a sole plate to which a housing is connected for movement between latching and releasing positions. The housing includes two generally parallel protrusions for engagement of the sole of a ski boot at the heel portion when the heel piece is moved to its latching position and when it is in its latching position. A linkage mounted within the housing is pivotally connected to the inside of the housing and to the sole plate of the binding. A yielding releasable latching means permits pivoting of the housing in its latching position away from the sole plate, but prevents pivoting beyond a limited range or arc. In the latching position, an axle along a pivotal axis of the linkage is permitted limited movement, but is prevented by a lever or cam from movement beyond that range. The limited range of movement permitted results in yielding of the heel piece and boot for skier comfort and for the accommodation of various thicknesses of boot soles. When forces exceeding the threshold are detected, a cockable release actuator is actuated freeing the axle from the influence of the lever or cam so that the housing can move to its releasing position Upon that movement of the housing, the boot sole and protrusions at the heel piece become disengaged so that the boot is released from the binding.

A cocking means including elements of the linkage and latching means cocks the release actuator when the housing is driven to its latching position from its releasing position. Preferably one of the protrusions on the housing acts as a pedal driven by the heel of a skier's boot to cock the release actuator. In that manner the step-in feature is achieved.

In one preferred embodiment, the linkage includes a dual pivoted, two arm linkage. The arms are pivotally connected together along a linkage axle. One arm is pivotally connected to the housing and the other arm is pivotally connected to a support mounted on the sole plate of the ski binding. A lever pivotally mounted on another support on the sole plate has a nose-like projection which, in its barring position, allows some swinging of the axle, but engages the axle to prevent the swinging of the axle to the releasing position. Upon a triggering of the binding release, the lever is pivoted out of its barring position by the release actuator so that the nose no longer bars the swinging of the axle. The arms of the linkage may then be fully extended to their releasing position under the influence of biasing forces which are exerted on the housing. When the housing is moved to its latching position, the axle bears upon the nose, pivoting the lever to drive the release actuator into its cocked position.

In another embodiment of the invention, the linkage includes an arm pivotally connected at one end to the inside of the housing and at its other end to an axle. A catch pivotally mounted on the housing may engage a pin mounted on a lever engaging the release actuator and pivotally connected to a support on the sole plate. The catch includes an angular slot, having two generally straight portions, through which the axle passes. When relatively small forces are applied by the boot sole to the heel piece, the heel piece yields through a limited arc, but the catch remains engaged on the pin. A cam pivotally mounted on the support has a cusp that confines the axle to one portion of the angular slot when the housing is in its latching position, preventing release of the housing to its releasing position. The permitted movement of the axle along the cam translates to yielding of the heel piece. When a force exceeding the predetermined threshold is present, the releasing actuator is actuated, pivoting the lever and the pin, disengaging the catch. As a result, the axle is transferred from one portion of the angular slot to the other. The transfer allows the axle to pass over the cusp so that the linkage extends and the housing moves to its releasing position. This action takes place under the influence of a biasing force applied to the housing which drives the housing to its releasing position, disengaging the heel portion of the boot sole from the binding heel piece.

When the housing is moved from its releasing position to its latching position, the axle remains in the one of the straight portions pivoting the nose of the cam out of the way as it passes. At the same time, the axle pivots the lever which drives the release actuator to its cocked position. Once the axle passes the cam, the cam pivots back, pushing the axle from one portion of the slot to the other resulting in engagement of the catch and pin. Thereby the step-in feature is achieved.

The invention is more clearly understood by reference to the drawing figures and the detailed description of the preferred embodiments.

DETAILED DESCRIPTION OF PREFERRED EMBODIMENTS

Generally, in a safety ski binding, a toe piece and heel piece are provided for grasping, respectively, the toe and heel portions of the sole of a ski boot. At least one of the pieces may be released and latched to release and grasp a ski boot, respectively. The description that follows concerns only a releasable and latchable heel piece, but it is understood that the complete binding also includes a passive or lockable toe piece.

The heel piece described is particularly useful with an electronic safety ski binding, i.e., one in which the forces acting on a skier's leg are measured by electrical transducers to produce an electical signal corresponding to each measured force and/or torque. The signals are processed to determine if predetermined threshold values are exceeded and represent a threat to the safety of a skier. When a threat to skier safety is detected, an electrical release signal is generated which preferably activates an electromechanical device, such as an iron slug slideably mounted within an electrical coil, to cause the heel piece to release its grasp on the ski boot sole. That is, upon generation of a release signal there is a transition in the heel piece from its latching position to its releasing position. However, the invention is not limited to electronic ski bindings. The invention may be used with any ski binding which produces a mechanical actuation in response to the detection of forces which are excessive with respect to the predetermined threshold.

Figure 1:
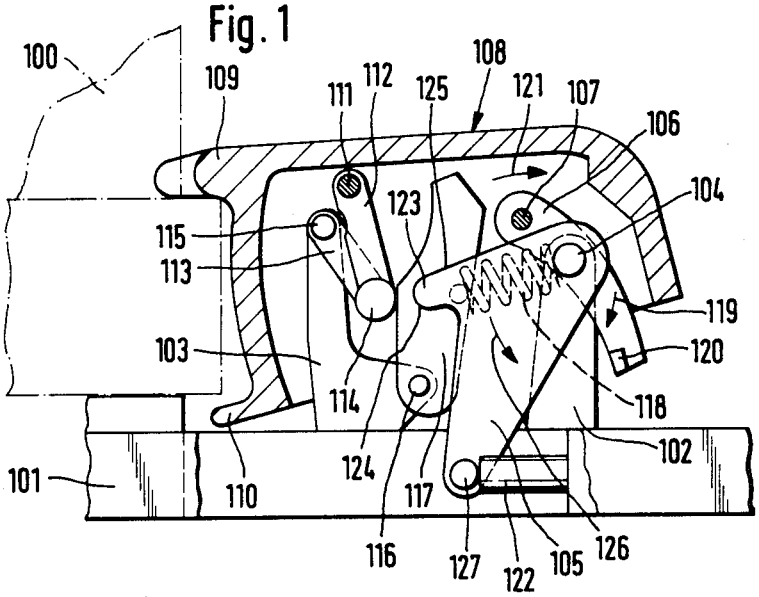
FIG. 1 is a cross sectional view of an embodiment of a ski binding heel piece according to the invention in its latching position with no stress applied by a ski boot engaged by the heel piece.

In FIG. 1, a cross sectional view, taken along a medial vertical plane, of an embodiment of a yielding, step-in heel piece according to the invention, is shown. The heel piece is shown mounted on a sole plate 101 which is supported on a horizontal surface. A portion of the heel section of a ski boot 100 which is received by sole plate 101 is shown in FIG. 1 in broken lines. A support 102 is mounted on sole plate 101 and includes an axle 104. A lever 105 and a blade 106 are pivotally mounted on axle 104. Blade 106 includes an axle 107 which is fixed to a housing 108. Housing 108 has latching and releasing positions between which it may be moved. Housing 108 includes, on its forwardmost surface, sole engaging means for engaging the sole of a ski boot. The embodiment of engaging means depicted in FIG. 1 includes two generally aligned, generally horizontal protrusions 109 and 110 for engaging the upper and lower surfaces of the heel portion of the sole of a ski boot. Preferably, the separation of protrusions 109 and 110 is greater than the maximum thickness of the boot sole expected to be encountered. As explained further below, the heel piece can accommodate boots having any sole thickness that is thinner than the separation of the protrusions.

In its latching position, shown in FIG. 1, housing 108 may be moved through a limited arc. A linkage support 103 is mounted on sole plate 101 within housing 108 toward the forward portion of the heel piece, i.e., toward the front tip of a ski on which the binding is to be mounted. By contrast, support 102 is mounted toward the rear of the ski.

Support 103 pivotally supports an axle 115, which is horizontal in FIG. 1, to which a linkage is connected. A first link 113 of the linkage is pivotally connected at its respective ends to axle 115 and to an axle 114. Axle 114 is horizontal in FIG. 1 and lies to the rear of support 103. Another link 112 of the linkage is pivotally connected at its respective ends to axle 114 and an axle 111. Axle 111, which is horizontal in FIG. 1, is firmly fixed in housing 108. As shown in FIG. 1, in the latching position, links 112 and 113 partially overlap, closing somewhat in the manner of scissor blades pivoted on axle 114. A rearward extension of support 103 near the sole plate carries another axle 116, horizontal in FIG. 1, on which is pivotally mounted urging means in the form of a cam 117. Cam 117 has an arcuate surface toward the front of the ski which axle 114 may follow. The arcuate surface of cam 117 guides axle 114 during movement of housing 108 to its latching position. Lever 105 and cam 117, blade 106 and links 112 and 113 are all preferably made from thin plate or thick sheet metal stock, for example, by punching.

Lever 105 extends downward into a chamber within sole plate 101 where a release actuator 122 protrudes from the rearward direction of the binding. A shaft 127 extends horizontally from lever 105 and is in contact with the end of actuator 122. A nose-like projection 123 on lever 105, defined by a lower surface 124 and an upper surface 125, extends toward the forward part of the heel piece, that is, in the direction of the front of a ski on which the heel piece is mounted.

Biasing forces are applied to various elements of the heel piece shown in FIG. 1 by conventional means such as helical springs, generally not shown. A helical spring 118 bears upon axle 104 and cam 117, urging the cam toward the front of the heel piece so that it bears on axle 114. Blade 106 has a blade moment 119 applied to it in a clockwise direction as viewed in FIG. 1. The rear portion of blade 106 extends downward toward sole plate 101 and includes at its tip a striking surface 120 which contacts support 102 when the heel piece is in its releasing position. A lever moment 126 is applied to lever 105, urging the lever counterclockwise in FIG. 1, to maintain contact between shaft 127 and release actuator 122. Housing 108 is under the influence of a housing biasing moment 121, clockwise in FIG. 1, which urges the housing toward its releasing position.

Figure 2:
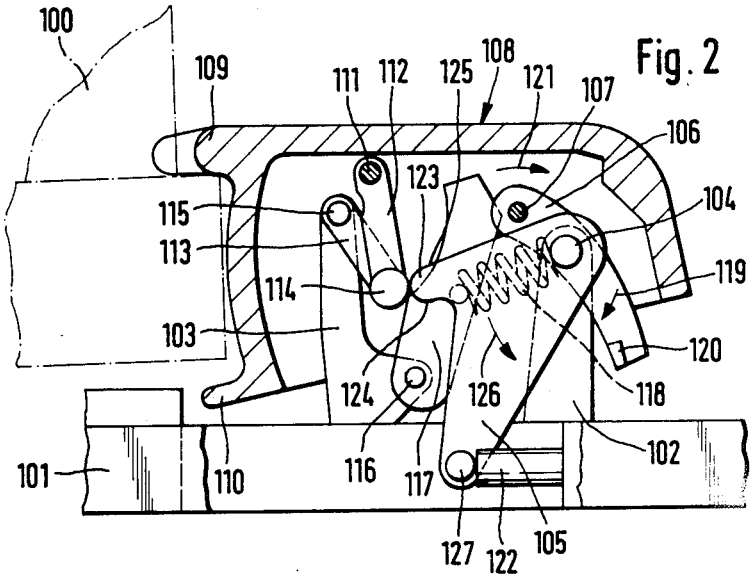
FIG. 2 is a cross sectional view of the heel piece of FIG. 1 in its latching position yielding under the influence of stress applied by an engaged ski boot.

In FIG. 1, the heel piece embodiment is in its latching position and boot 100 rests flat on the sole plate 101 without any stress tending to lift the boot heel from the sole plate. Nose 123 of lever 105 is retracted and does not contact any other element. In FIG. 2, ski boot 100 has been tipped forward, so that its heel is raised off sole plate 101. The top edge of the boot sole at its heel contacts protrusion 109 raising housing 108, at its forward end, off, i.e., away from, sole plate 101. The lifting of the housing causes axle 114 to begin an arcuate path toward the rear of the heel piece and away from sole plate 101. As it follows that path, axle 114 eventually engages nose 123 of lever 105. Lever 105 blocks further movement of axle 114 and movement of housing 108 beyond a limited range. In its latching position, lever 105 thereby permits the linkage and housing 108 to yield, but prevents the housing from assuming its releasing position. In the absence of any force tending to raise boot 100 of sole plate 101, spring 118 pushes cam 117 forward. Cam 117 bears on axle 114 urging it forward tending to maintain housing 108 in its latching condition shown in FIG. 1. The strength of spring 118 determines the force required to produce yielding of housing 108 while it is in its latching position.

As FIGS. 1 and 2 make clear, the heel of the ski boot may raise off and lower onto sole plate 101 without release of the heel piece. This tolerance or "play" is helpful in avoiding skier fatigue. Moreover, the same tolerance allows boot soles of various thickness to be used with the heel piece. A sole as thick as the separation of protrusions 109 and 110 may be used or a much thinner sole may be used. The only consequence of a sole thickness change is to reduce or increase the range of the yielding movement by housing 108.

Figure 3:
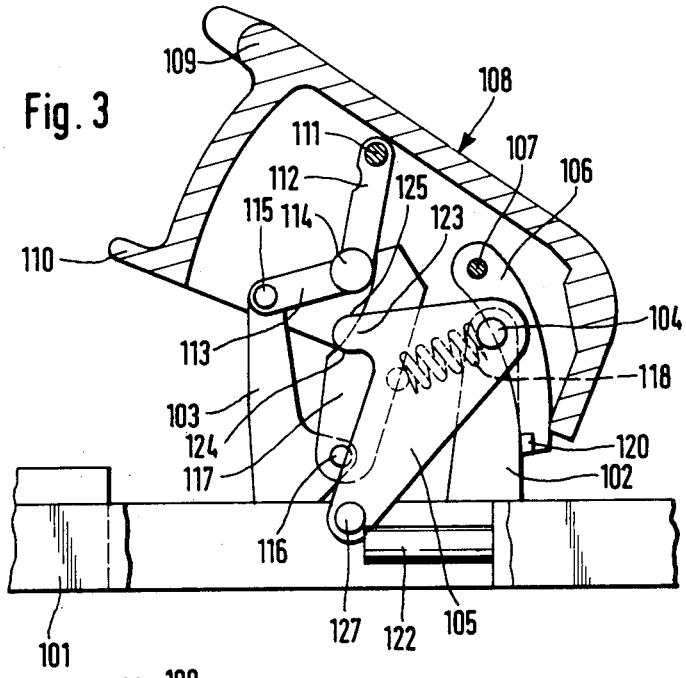
FIG. 3 is a cross sectional view of the heel piece of FIG. 1 in its releasing position.

In FIG. 3, the heel piece embodiment is shown in its releasing position. A release signal has been generated and release actuator 122 has been thrown forward. Actuator 122 has pushed shaft 127 forward so that lever 105 is pivoted, clockwise in FIG. 3, against the urging of biasing moment 126. As a result of the pivoting, nose 123 is retracted and cannot block the movement of axle 114. Therefore housing 108, under the influence of biasing moment 121, moves to its releasing position and links 112 and 113 are extended. Simultaneously with said movement of said housing 108 (which occurs about said axle 107) blade 106 is moved by means of a spring which is schematically represented by an arrow 119 in the direction of the arrow head. Typically, said spring is arranged between support 102 and blade 106. As housing 108 reaches its releasing position its lowermost rear edge strikes the rear portion of blade 106. The movement of housing 108 is stopped when striking surface 120 of blade 106 strikes support 102. Blade 106 is then pinched between housing 108 and support 102 and the engagement between protrusions 109 and 110 and the sole of a ski boot is released.

Figure 4:
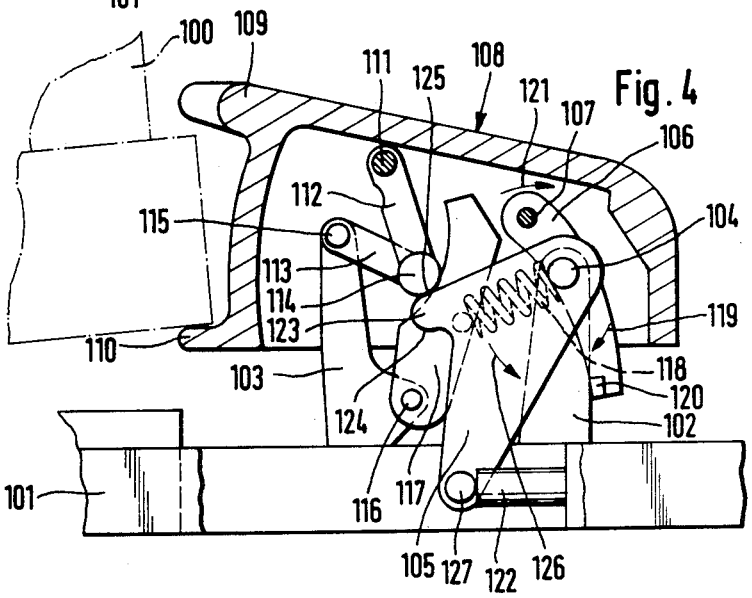
FIG. 4 is a cross sectional view of the heel piece of FIG. 1 in its releasing position in the course of being latched.

FIG. 4 shows the heel piece embodiment in the course being latched after it has been released. The heel of ski boot 100 engages protrusion 110 of housing 108 as a pedal and drives it down, i.e. toward sole plate 101. Axle 114 is thereby caused to follow the arcuate portion of cam 117 and contacts the top, i.e., curved portion 125, of nose 123 on lever 105, as shown. Lever 105 is pivoted on axle 104, counterclockwise as seen in FIGS. 1 through 4. Shaft 127 thereby pushes release actuator 122 back into its cocking position, and a bit beyond it, as axle 114 finally slips past nose 123. Once axle 114 passes nose 123, the heel piece is latched in its latching position. The biasing force on cam 117 then pushes axle 114 back to the latching position shown in FIG. 1. Actuator 122 is preferably normally biased out of its retainer and has a detent or latch means to hold it in place once the actuator is returned to its cocked position. Such latch means is described in a U.S. patent application filed in the European Patent Office according to the Patent Cooperation Treaty on Aug. 17, 1982 in the name of one of the co-inventors of this application.

It should be noted that during the last phase of the step-in movement (transition from the position of FIG. 4 to the position of FIG. 1) also a pivotal movement of blade 106 occurs. Said movement takes place in a direction opposite to the direction of arrow 119 and causes simultaneously a movement of said housing 108 towards said ski boot 100 and forces said ski boot 100 against the toe piece.

Figure 5:
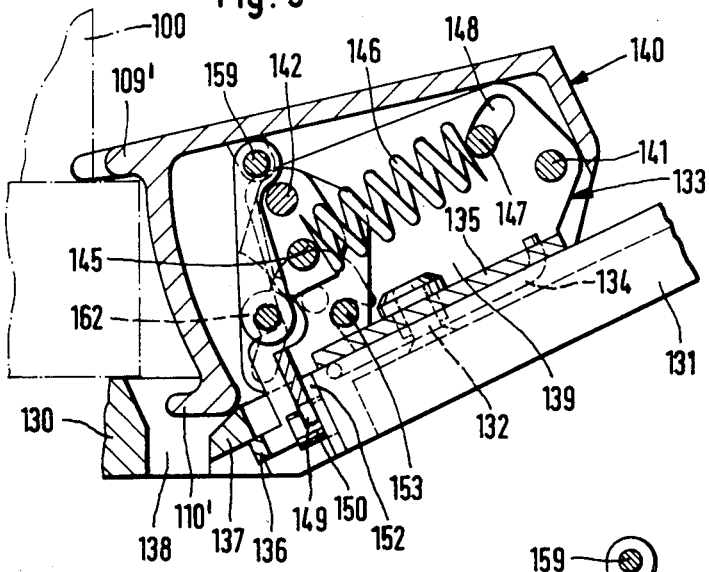
FIG. 5 is a cross sectional view of an embodiment of a ski binding heel piece according to the invention in its latching position with no stress applied by a ski boot engaged by the heel piece.
Figure 5B:
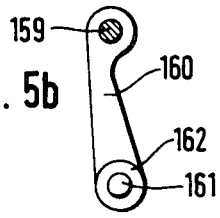
FIGS. 5*a*, 5*b*, 5*c* and 5*d* are side views of elements used in the heel piece depicted in FIG. 5.
Figure 5A:
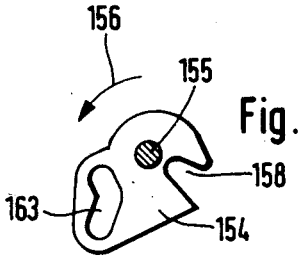
Figure 5D:
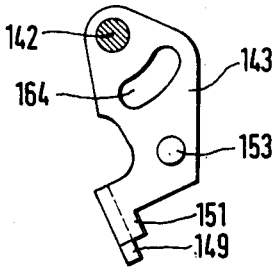
Figure 5C:
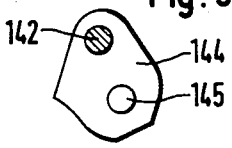
Figure 5E:
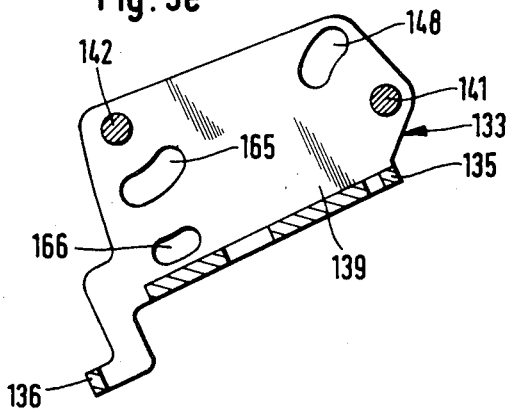
FIG. 5*e* is a cross sectional view of a part used in the heel piece embodiment depicted in FIG. 5.
Figure 5F:
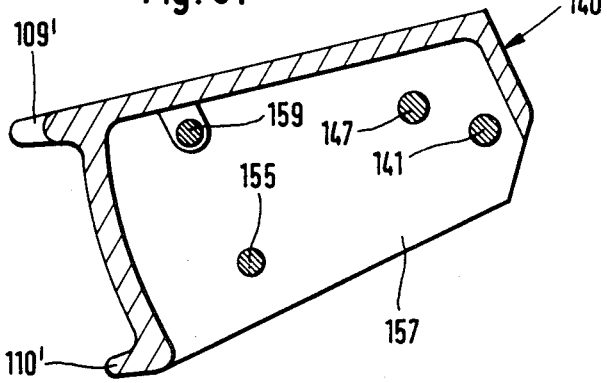
FIG. 5*f* is a cross sectional view of a housing used in the heel piece embodiment depicted in FIG. 5.

Another preferred embodiment of the step-in yielding heel piece invention is shown in FIG. 5 in a cross sectional view along a transverse plane offset from the middle of the heel piece. Among the differences between the embodiments of FIGS. 1 and 5 is that the embodiment of FIG. 5 slants upward toward the rear. Accordingly, the sole plate 130 of the heel piece has an angled portion 131. Again, a ski boot 100 is shown in broken lines. The embodiment of the invention shown in FIG. 5 is symmetrical about a medial vertical plane. Some of the elements of the embodiment are shown in broken lines in FIG. 5. One of each of the symmetricallly placed elements is shown in FIGS. 5*a*, 5*b*, 5*c* and 5*d*. It is understood that the symmetrical elements are described with respect to the depicted portion and that the description also applies to the symmetrical portion not shown. A cross section of a U-shaped element used in the embodiment is shown in FIG. 5*e*. A cross section of the housing 140 employed in the embodiment is shown in FIG. 5*f*. An understanding of the placement of the pairs of parts and the symmetrical parts within housing 140 is aided by reference to FIG. 9, a cross sectional view, transverse to that of FIG. 5, taken along line IX—IX of FIG. 8. FIG. 9 likewise shows the location of the sectioning, along line VIII, which is the basis of the views of FIGS. 5, 6, 7 and 8.

The embodiment of FIG. 5 includes a support means or retainer 133 having a bridge section or a base plate 135 by which the embodiment is maintained on angled portion 131 of a sole plate 130. Base plate 135 is attached to angled sole plate portion 131 by a pin or screw 132 and a spring lever 134 which extends from screw 132 and through an arcuate slot in portion 131. This attachment arrangement permits some side-to-side movement of the heel piece when housing 140 is unlatched, against the bias of a spring lever 134. Means described below prevent such sideways swivelling when housing 140 is latched.

Housing 140 includes two generally parallel protrusions 109' and 110' on the forward portion of housing 140 for engaging the sole of a ski boot. Plate 135 forms the base of the square cornered U-shaped retainer 133 for supporting the axles which pass through other elements. A cross sectional view of retainer 133 depicting one arm 139 of the U-shape is shown in FIG. 5*e*. Retainer 133 is described with respect to arm 139 which is shown in FIG. 5 and 5*e;* but it is understood that both arms of the U are symmetrical and that each slot, hole and axle described for arm 139, also appears in or passes through the other arm. As noted above, retainer 133 is fixed to the ski. Arm 139 carrier axles 141 and 142. Housing 140 is pivotally mounted on axle 141. Retainer arm 139 also contains an arcuate slot 148 at its upper rear portion through which a shaft 147 passes. Shaft 147 is fixed in housing 140. Slot 148 has a central axis along an arc of a circle centered on axle 141. Near its upper forward extension, retainer arm 139 has an aperture through which an axle 142 extends. At the forward portion of arm 139 below axle 142, i.e., toward base plate 135, retainer arm 139 contains an arcuate slot 165 which has a central axis lying on an arc of a circle centered on axle 142. At the forward part of retainer arm 139, near plate 135, arm 139 contains an arcuate slot 166 having a central axis lying on an arc of a circle centered on axle 142. On the extreme forward portion of retainer 133, arms extend downward and forward terminating in a symmetrical pair of fingers. One of the pair, a finger 136 is shown in FIGS. 5 and 5*e*. The fingers lie below plate 135 within a chamber 138 in the binding in which a release actuator 150 lies and moves upon receipt of a release command. The fingers serve as guides for the moving parts within the chamber. Said fingers are quided under and by means of a transversely extending part 137. Said part 137 extends across said chamber and is an integral portion of said sole plate 130.

A shaft 155 fixed to housing 140 carries a pivoting catch 154. Catch 154 includes an angular slot 163 having two intersecting, generally straight portions for receiving and pivotally engaging axle 161. A peripheral opening 158 in catch 154 forms a hook for releasably engaging a projecting pin 153. Pin 153 is mounted on a lever 143 which is pivotally connected to axle 142. Catch 154 engages pin 153 when the heel piece is in its latching position. One of the symmetrical sides of lever 143 is shown in FIG. 5*d*. A bridging portion 149 joining the two halves of the lever 143 is indicated by the broken line in FIG. 5*d* and is most clearly seen in FIG. 9. Lever 143 includes an arcuate slot 164 having a central axis lying on an arc of a circle centered on axle 142. The lowest forward portion of lever 143 includes an arm 151 terminating in bridging portion 149 which, in the assembled heel piece, extends into the chamber containing release actuator 150. Release actuator 150 includes a recess engaged by bridging portion 149. When release actuator 150 is triggered and moves, bridging portion 149 is carried along by the actuator. Thereby, lever 143 pivots about axle 142. Pivoting of lever 143 causes pin 153 to move and thereby pivot the catch 154 clockwise (cf. FIG. 5*a*) against the force exerted by a spring 156. Lever 143 has a stop 151 (actually, because of the mentioned symmetrical design, there are two stops 151 at opposite sides of the bridging portion 149) which cooperates with an element 152 located above actuator 150 for preventing the sideways swivelling of retainer 133 about pin 132 when the binding is in the latched condition.

As FIG. 9 shows, a catch 154 is mounted against each inside wall of housing 140. Next to and between the catches, the retainer arm 139 is mounted. Moving further inside housing 140 from each side, two levers 143 followed by two cams 144 are pivotally mounted on axle 142. One of the cams 144 is shown in FIG. 5*c*. It includes a projecting pin 145 which in the assembled heel piece protrudes through arcuate slot 164 in lever 143 into arcuate slot 165 in retainer arm 139. Cam 144 includes a cusp on its forward edge. The cusp is formed by two complex curved intersecting edges. Finally, the innermost of the symmetrical elements shown in FIG. 9 is a linkage arranged in housing 140. A link 160, which is part of the linkage, is shown in FIG. 5*b*. The top, i.e., the part furthermost from plate 135 in the assembled heel piece, of link 160 is pivotally attached to an axle 159 which is retained near the inside top of housing 140 by a support depending from housing 140. The opposite end of link 160 includes a hub or roller 162 through which the axle 161 of the linkage passes for pivotal connection of arm 160 to catch 154. Hub 162 adds thickness to link 160 so that hub 162 may bear upon and ride along the guide provided by the curved surfaces of cam 144. Axle 161 also passes through the angular slot in catch 154. A spring 146 biases shaft 147, mounted in housing 140, and pin 145, on cam 144, apart, urging housing 140 to move toward its releasing position.

In FIG. 5, ski boot 100 is shown placed on sole plate 130 with no stress being applied to the heel piece by the boot. Protrusion 109' engages the top of the boot sole and restrains it toward sole plate 130. Because of the angle in the binding, the sole plate includes a chamber 138 for receiving heel engagement protrusion 110' in the latching position shown. The thickness of the boot sole determines how much of protrusion 110' lies within chamber 138. As explained before, various thickness boot soles may be accomodated since the heel piece yields to some degree under upward stress. In the latching position, shown in FIG. 5, shaft 147 is in the forward portion of arcuate slot 148 in retainer arm 139. Hub 162 is separated from and lies below the cusp of cam 144 within a cut out portion of lever 143 intended to receive it. Axle 161 lies in the upper straight portion of angular slot 163 of catch 154. Opening 158 in catch 154 engages pin 153. Axle 161 is held down, toward sole plate 130, along with link 160 and housing 140. This is achieved by means of spring 156 which urges catch 154 counterclockwise into its normal position shown in FIGS. 5 and 7.

When upward stress is placed on the heel piece by the boot sole, housing 140 yields, but does not move all the way to its releasing position. The releasable latching means yields, but does not release. The upward force pulls link 160 away from sole plate 130. Hub 162 of latch 160 engages cam 144 and rides up said cam 144. Because of the cusp on cam 144, said cam 144 is pushed toward and against spring 146 as housing 140 rises. The forward movement of hub 162 is resisted by the engagement of catch 154 on pin 153, so that the cusp on cam 144 confines axle 161 to one of the straight portions of angular slot 163. Thereby axle 161 is prevented from moving beyond a limited range. In this way, housing 140 is prevented in its latching position from moving to its releasing position, but the latching means yields to allow some movement of housing 140 while it is in its latching position. Spring 146 ensures that cam 144 remains in contact with hub 162. As one skilled in the art will appreciate, the parts described must be shaped and located so as to cooperate as described to achieve the advantages of the invention. Retainer 133, bracket 143, cam 144, catch 154 and arm 160 are preferably punched from, thick sheet metal or thin metal plate. Pins and hubs are added by conventional means.

Figure 6:
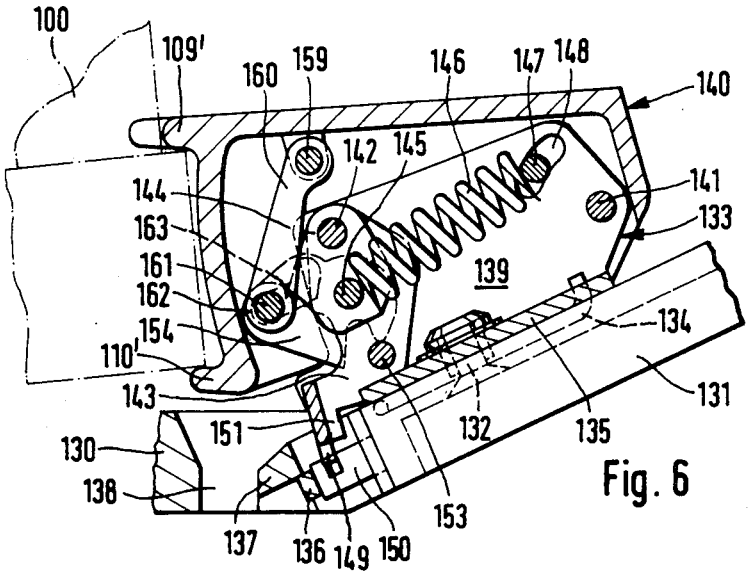
FIG. 6 is a cross sectional view of the embodiment of a heel piece shown in FIG. 5 just after activation of its release actuator.

When the binding detects forces exceeding the predetermined safety threshold, release actuator 150 is triggered and thrown forward. In its movement, actuator 150 carries with it the bridging portion 149 of lever 143. The instant after the actuation of actuator 150 is shown in FIG. 6. The pivoting forward of lever 143 rotates catch 154 about axle 155 against spring 156. Catch 154 is then lifted away from sole plate 131 under the influence of the bias on housing 140. Axle 161 is thereby forced by the forward force applied by the cusp on cam 144 from one straight portion of angular slot 163 in catch 154 to the other. Cam 144 resists moving out of the path of hub 162 because spring 146 applies a force to cam 144 which is larger than the force applied by spring 156 to catch 154 and in turn to hub 162. The change in position of axle 161 from one straight portion of slot 163 to the other allows axle 161 to move forward and pass by the cusp. This chain of movements is driven by spring 146 which maintains a moment, clockwise as viewed in FIG. 6, on housing 140 tending to move it toward its releasing position. In the movement depicted in FIG. 6, shaft 147 has begun to move within arcuate slot 148 of retainer arm 139 from a forward to a rearward position as the housing moves toward its releasing position.

Figure 7:
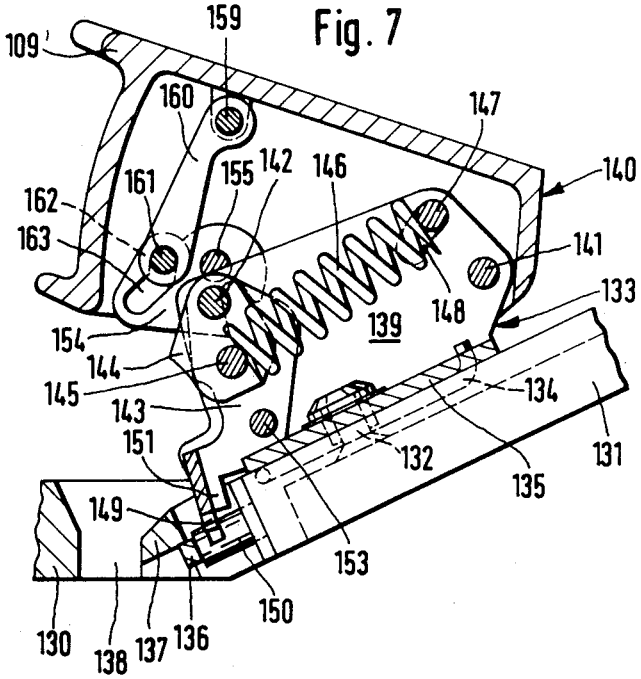
FIG. 7 is a cross sectional view of the embodiment of a heel piece shown in FIG. 5 in its releasing position.

FIG. 7 shows housing 140 in its releasing position. After the release, housing 140 moves until shaft 147 travels as far as possible in arcuate slot 148; then further movement of housing 140 is blocked and the position shown is achieved. That is, slot 148 acts as a stop means for stopping movement of the housing just as blade 106 did in the other described embodiment. After hub 162 is in a position away from said cam 144 (cf. FIG. 7), said catch 154 moves, due to spring 156, back into its normal position, whereby axle 161 is also moved into the upper straight portion of angular slot 163.

The pivotal movement of lever 143 frees the stops 151 from element 152 (said element 152 being arranged above release actuator 150 on angled portion 131 of sole plate 130, so that the support means 133 can pivot against the force of spring 146 in a rightward and leftward direction respectively. Said pivotal movement takes place about pin 132 with a predetermined amount limited by chamber 138. This allows for a safe release of the ski boot specifically in the instance of a lateral release, i.e. a release where only a torque is present.

Figure 8:
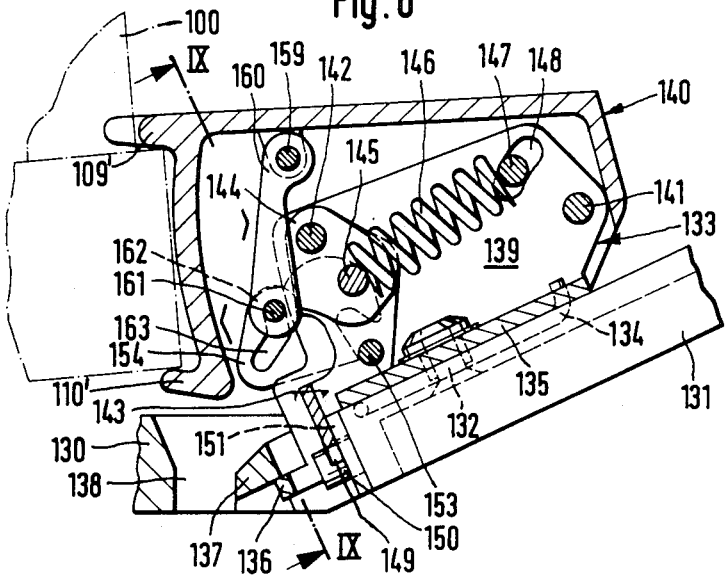
FIG. 8 is a cross sectional view of the embodiment of a heel piece shown in FIG. 5 in its releasing position in the course of being moved to its latching position.
Figure 9:
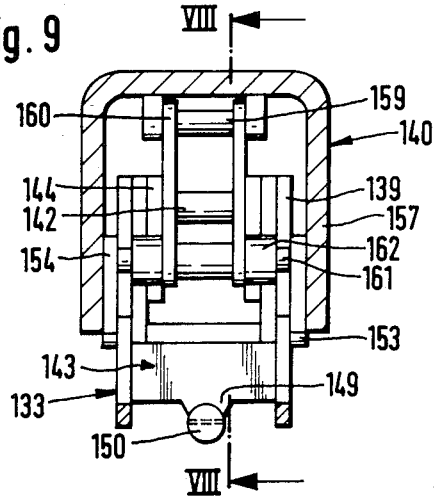
FIG. 9 is a transverse cross sectional view of the embodiment of a heel piece shown in FIG. 8 taken along lines IX—IX.

In FIG. 8, the heel piece is shown being latched by insertion of a ski boot 100. The sole of the boot presses down on protrusion 110' so that it is a pedal driving housing 140 toward sole plate 130. Hub 162 presses against cam 144 and, since hub 162 is now above the cusp on cam 144, hub 162 also exerts pressure on spring 146. Cam 144 rotates about axle 142 against the urging of spring 146, to allow hub 162 to pass by the cusp. At the same time, hub 162 is bearing on the front edge of lever 143 pushing it rearward so the release actuator 150 is pushed back into sole plate position 131 slightly beyond the latched position of the actuator 150. The actuator is then allowed to move forward to its latched position, being restrained by the latch or detent means associated with the release means. Such a latch means is described in the U.S. patent application filed according to the PCT previously referred to herein. That is, lever 143, under the influence of the driving force of ski boot 100 cocks actuator 150 so that the binding has step-in convenience. Once hub 162 passes the cusp on cam 144, cam 144 resumes the position it has in FIG. 5. With the counterclockwise rotation of housing 140, pin 153 comes into engagement with peripheral opening 158.

In both of the described embodiments, and in other embodiments of the invention, it is convenient to provide a means for release of the heel piece by the skier in the absence of a threatening force. In the case of an electronic binding, the elective release may be conveniently actuated by a push button switch so that the circuitry causes the release actuator to be thrown.

The invention has been described with reference to certain preferred embodiments. Various additions and modifications will occur to those skilled in the art. Accordingly, the scope of the invention is limited solely by the following claims.

In principle, the invention relates to a safety ski binding comprising an electronic circuit which actuates an electromagnet. At least one transducer means is provided which determines the forces and/or torques acting upon the leg of a skier. As soon as a predetermined threshold value is reached, said electromagnet is actuated. The electromagnet releases the latching means of a binding portion (housing means) from its latching position. Specifically, the binding portion is a heel holding means. Said binding portion is spring-loaded by means of at least one spring 121, 146 in a direction of its opening position. Said binding portion is held in its latching position by means of said latching means 105; so as to release said latching means, a release means 122, 150 is provided which can be actuated through the force of at least one energy storing means, preferably in the form of a spring; that force is a multiple of the force provided by the electromagnet. Said binding portion 108, 140 comprises a closing pedal 110 which is the initial or first member of a kinematic chain which specifically provides for a cocking of the energy storing means when a step-in action occurs. Specifically a cocking member is provided in the form of a lever 105, 143 arranged parallel to the binding portion. Said lever 105, 143 comprises a cam portion for cooperation with a cocking element 114, 162 connected with said binding portion. Preferably, the invention provides for means for creating a resilient range of movement for the binding portion (i.e. the housing 108, 140) in the latching position of said portion.

Preferably, a cam disk 117, 144 is loaded by means of a spring 118, 146 for cooperation with said cocking element, in particular a roller 114, 162. Said roller is arranged at the free end of a lever 112, 160 which is supported in the binding portion parallel to the pivot axis 107, 141 thereof.

It should be noted that all features disclosed in the description, the claims and the drawings are considered to be of inventive character, be it that they are taken individually or in combination.

In summary, the ski binding of the invention provides for automatic "step-in" cocking of the energy storing means of the release means and a resilient or elastic accomodation of soles having varying thicknesses or having snow adhered thereto. Moreover, the means 118, 146 providing the resilient accomodation may also be cocked during said "step-in" action; also at the same time the opening spring 146 for the housing may be cocked simultaneously.

We claim:

1. A heel piece for a step-in, yielding electronic ski binding for releasably latching a ski boot from the binding upon actuation of a cockable release actuator, said heel piece comprising:

sole plate means fixable to ski;

housing means including sole engaging means for engaging the sole of a ski boot;

connection means interconnecting said housing means and said sole plate means for movement of said housing means between latching and releasing positions, said connection means including a first link arm having first and second ends, said first end being pivotally connected to axle means and said second end being pivotally connected to said housing, said axle means movable along a predetermined path as said housing means moves between said latching and releasing positions;

cam means pivotal about an axis stationary with respect to said base plate, said cam means including surface means bearing on said axle means for urging said axle means to move said housing means toward its latching position;

latching lever means, separate from said cam means, pivotal about an axis stationary relative to said sole plate means for releasably latching said housing means in its latching position, said latching lever means including surface means for engagement with said axle means, said lever surface means operative with said cam surface means for preventing movement of said housing means beyond a limited range when said housing is in its latching position; and cocking means for cocking the cockable release actuator when said housing means is moved to its latching position.

2. The invention of claim 1 wherein said latching lever means comprises lever means pivotally connected to said sole plate means and including a nose for engaging said axle means.

3. The invention of claim 2 wherein said lever means is engageable by the release actuator for pivoting said lever means upon actuation of said actuator to prevent engagement of said nose and said axle means when said housing means moves from its latching position to its releasing position.

4. The invention of claim 2 said lever means is engageable by the release actuator, and said cocking means comprises said axle means for engaging said nose and for pivoting said lever means to cock said actuator when said housing means moves from its releasing position to its latching position.

5. The invention of claim 1 wherein said connection means comprises axle means mounted to said housing means, catch means pivotally mounted on said housing means for engaging pin means when said housing means is in its latching position, and an arm having first and second ends, said first end carrying said axle means and said second end being pivotally connected to said housing means.

6. The invention of claim 5 wherein said releasable latching means comprises support means mounted on said sole plate means, lever means pivotally mounted on said support means for engaging said release actuator, pin means mounted on said lever means for being engaged by said catch means when said housing means is in its catching position and for releasing said catch means upon actuation of said release actuator.

7. The invention of claim 6 wherein said catch means includes a peripheral opening for engaging said pin means.

8. The invention of claim 6 said releasable latching means further comprising cam means pivotally mounted on said support means, for engaging said axle means to prevent said housing means from moving beyond said limited range when said housing means is in its latching position.

9. The invention of claim 8 wherein said catch means includes a slot having two intersecting portions, said axle means passing through said slot, wherein said cam means includes cusp means for urging said axle means, and wherein said axle means is movable from one of said portions to the other upon actuation of said release actuator, due to the rotation of catch means.

10. The invention of claim 9 wherein said cam means includes cusp means for providing said axle means and said housing means with a limited range of resilient movement when said housing is in its latching position.

11. The invention of claim 6 wherein said cocking means includes said axle means for engaging and pivoting said lever means to drive said release actuator to its cocking position when said housing means is moved from its releasing position to its latching position.

12. The invention of claim 11 wherein said cocking means further includes said catch means and cam means, said cam means being pivotally mounted to said support means for engaging said axle means when said housing means is moved from its latching position to its releasing position, and said catch means includes a slot, said axle means passing through said slot.

13. The invention of claim 12 wherein said slot includes two intersecting portions and said cam means includes cusp means upon which said axle means is urged so as to pivot said cam means against spring means when said housing means is being moved from its releasing position to its latching position.

14. The invention of claim 1 and further comprising blade means pivotally mounted on said sole plate means, said housing means being pivotally mounted on said blade means for abutting structure fixed on the ski to limit the movement of said housing means in the releasing position.

15. The invention according to claim 14 and further comprising spring means for a biasing said blade means into abutment with structure fixed on the ski in response to movement of said housing means to the releasing position.

16. The invention of claim 1 and further comprising support means fixable on a ski for supporting said housing means for movement between latching and releasing positions and swivel means for enabling limited movement of said support means from a straight position aligned with the sole plate to positions transverse to said sole plate.

17. The invention of claim 16 and further comprising spring lever means for urging said support means towards the straight position.

18. The invention of claim 16 and further comprising lever means mounted on said support means when said housing means is in the latched position.

* * * * *